US006431029B1

(12) United States Patent
Hawkins, III

(10) Patent No.: US 6,431,029 B1
(45) Date of Patent: Aug. 13, 2002

(54) MANEUVERABLE WELLBORE TUBULAR MAKEUP AND BREAKOUT APPARATUS AND METHOD

(75) Inventor: Samuel P. Hawkins, III, Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 0 days.

(21) Appl. No.: 09/776,205

(22) Filed: Feb. 2, 2001

(51) Int. Cl.[7] ..... B25B 29/00
(52) U.S. Cl. ..... 81/57.25; 81/57.35; 81/57.41
(58) Field of Search ..... 81/57.24, 57.25, 81/57.35, 57.4, 57.41

(56) References Cited

U.S. PATENT DOCUMENTS 1,486,125 A * 3/1924 Crockett ..... 81/57.25 X
2,854,217 A * 9/1958 Benjamin ..... 81/57.41 X
4,348,952 A * 9/1982 Boyadjieff ..... 81/57.25 R
5,259,275 A * 11/1993 Schulze-Beckinghausen ..... 81/57.34 X
5,386,746 A * 2/1995 Hauk ..... 81/57.34 X
5,553,991 A * 9/1996 Ferreira ..... 81/57.41 X
5,868,045 A * 2/1999 Hauk ..... 81/57.34 X
5,960,678 A * 10/1999 Kennedy ..... 81/57.41 X

* cited by examiner

*Primary Examiner*—James G. Smith
(74) *Attorney, Agent, or Firm*—The Matthews Firm

(57) ABSTRACT

A maneuverable powerjaw apparatus for making and breaking joints of well bore tubular is provided for operation on a rig floor. Preferably a plurality of wheels are mounted to a mobile housing in a reverse tricycle orientation that permits high maneuverability of the mobile housing including rotation in position. Preferably, the two forward wheels are individually powered by hydraulic motors. Vertical orientation of the mobile housing is preferably provided by hydraulic struts that, once the mobile housing is positioned adjacent the pipes on the rig floor, permit the power jaws to be positioned at the correct vertical position on the joints for making, breaking, and spinning of the pipes. In one presently preferred embodiment, a pivotal connection is provided between the mobile housing and a frame to which torque arms are attached. In this embodiment, the frame rotates with respect to the well bore tubular as the joints are made or broken while the mobile housing may remain stationary.

21 Claims, 6 Drawing Sheets

MANEUVERABLE WELLBORE TUBULAR MAKEUP AND BREAKOUT APPARATUS AND METHOD

BACKGROUND OF THE INVENTION

1. Field of the Invention

The present invention relates generally to making up and breaking out well bore tubular and, more particularly, to apparatus and methods for a makeup and break out tool that is readily maneuverable in a rig floor environment.

2. Description of the Background

Makeup and break out tools are used to spin, makeup, and break out well bore tubular that may have a wide range of diameters. It has been found by oil companies that separate, manually operated tongs, spinners, and/or chains are often significantly slower in making up and breaking out well bore tubular than a single tool or unit that does all such functions. The speed advantages of a single unit include factors such as eliminating the need to redress tongs when changing from drill pipe to collars and the integration of spinning with makeup and break out functions. Due to the high daily cost of drilling rigs, the time savings can be substantial. Comparison studies between use of traditional separate tongs and spinners as compared with a single unit makeup and break out tool have shown cost savings that may range from one-quarter of a million to more than a million dollars per well. Another time saving advantage is that a self-contained unit can be used to make up or break out pipes at difficult positions in the rig or derrick - a feature that can save a great amount of time especially in certain situations that occasionally occur, e.g., stuck pipe. Furthermore, when desired, pipes can be readily made up or broken out while in the mousehole with the rig otherwise occupied. An exemplary self-contained unit for making and breaking joints in pipe strings is shown in U.S. Pat. No. 5,868,045 and U.S. Pat. No. 5,386,746 which are incorporated herein by reference.

The self-contained system operates more reliably than separate tongs and spinners by providing a central torque regulator that connects to and controls all components to assure consistent makeup. This feature prevents thread damage caused by over tightening and automatically prevents errors that could result in under-torqued connections.

The system eliminates accident conditions associated with separate independent tongs readily exposed on the floor, and the attendant separate cables used to pull on each separate tong, and use of snatch blocks. Safety is also improved because providing a single tool to perform all such functions rather than separate elements permits the use of central safety features such as, for instance, a lockout to prevent spinner operation if the tongs are not engaged, a safe location for the operator to stand and work, a design whereby the operator's hands and feet are safely away from moving parts, elimination of spinning chains, and a lockout to prevent operation of the lift cylinder when any tong is engaged.

Because of the great utility of a self-contained unit to makeup and break out pipes, it has been found desirable to make further improvements. For instance, a support line is normally secured to the top of the unit to support the unit and permit mobility of the unit. Even though the unit actually requires only one line as compared to at least two support lines used to support separate tongs as well as pull lines for pulling on each separate tong, it would nonetheless be desirable to eliminate the support line on some rigs due to limited line availability. Moreover, because a self-contained unit will necessarily have considerable weight, effort is required, usually involving two people, to initially pull the makeup and break out unit to the desired connection. While even these factors are at least on a par or typically better than use of separate tongs and spinners which require at least two support lines and two pull lines and at least two or three people to operate the tongs and pull lines, nonetheless it would be desirable to control a makeup and break out unit with a single operator using automated controls without the need for any lines.

One commercially available system uses two straight tracks wherein motored wheels move the make-up and break-out tool forward and backward. However, this configuration uses rig floor space at all times, may not be used elsewhere on the rig floor, is very limited in operational positioning, and may be difficult to adapt to many rig floor arrangements.

Consequently, there remains a need for a self-contained makeup and break out unit that permits a single operator to perform the function of making and breaking the joints of well bore tubular. It would also be desirable to eliminate the requirement for a support line. However, it would be desirable to maintain the ability to use a line to permit the unit to be used in odd locations when desired and/or for transport purposes. Those skilled in the art have long sought and will appreciate the present invention which provides solutions to these and other problems.

SUMMARY OF THE INVENTION

The present invention was designed to provide more efficient operation to thereby reduce drilling costs, improve reliability of making and breaking pipe joints, permit increased automation to reduce required manpower, improve safety, and to free other rig equipment for other uses.

Therefore, it is an object of the present invention to provide an improved self-contained unit for making and breaking well bore tubular.

Another object of the present invention is to automate most of the functions of making and breaking of pipe joints for more efficient operation.

Yet another object of the present invention is to provide a means for powered 3-dimensional movement of a self-contained pipe making and breaking unit.

Yet another object of the present invention is to free up equipment on a rig such as support lines.

An advantage of the present invention is improved rig safety.

Another advantage of the present invention is faster operation.

Yet another advantage is improved reliability and consistency in making up joints.

These and other objects, features, and advantages of the present invention will become apparent from the drawings, the descriptions given herein, and the appended claims.

Therefore, the present invention provides for a maneuverable powerjaw apparatus for making and breaking joints of well bore tubular which comprises at least two powered torque arms for applying torque to the joints of the well bore tubular. A support member supports the powered torque arms. A mobile frame supports the support member and the two powered torque arms. The support member is preferably movable with respect to the mobile frame. One or more hydraulically movable members are mounted between the support member and the mobile frame. One or more wheels are mounted to the mobile frame.

A first wheel and a second wheel are mounted to the mobile frame with a fixed orientation. A first hydraulic control motor may be used to activate the first wheel, and a second hydraulic control motor may be used to activate the second wheel. Preferably, the two wheels are mounted to the mobile frame such that a straight line passes through each of the two wheels and a respective of the well bore tubular when the at least two power torque arms apply the torque.

In other words, a maneuverable power jaw apparatus is provided for making and breaking joints of well bore tubular such that the maneuverable power jaw apparatus may be operable on a rig floor. A mobile frame supports a support member to which at least two powered torque arms are attached. At least three wheels are mounted to the mobile frame to permit movement of the mobile frame on the rig floor. At least one movable member is mounted to the mobile frame and the support member for affecting movement between the mobile frame and the support member. Preferably the movable member comprises a hydraulic rod for vertically moving the support member with respect to the mobile frame.

In operation, a method is provided for a power jaw apparatus for making and breaking joints of well bore tubular which includes mounting the power torque arms in a housing and steering the housing in a left-hand direction or right-hand direction on the rig floor. Preferably, steering is accomplished by activating a hydraulic motor. Moreover, by controlling power applied to two wheels with a fixed orientation steering may be affected because the wheels are preferably positioned in a reverse tricycle orientation. At least one wheel, at the rear of the housing, has a rotatable orientation and follows movement controlled by the two front wheels. The powered torque arms are preferably hydraulically lifted for vertical engagement with a respective of the joints. Preferably wheel guards are provided on the housing around the plurality of wheels.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

Figure 1:
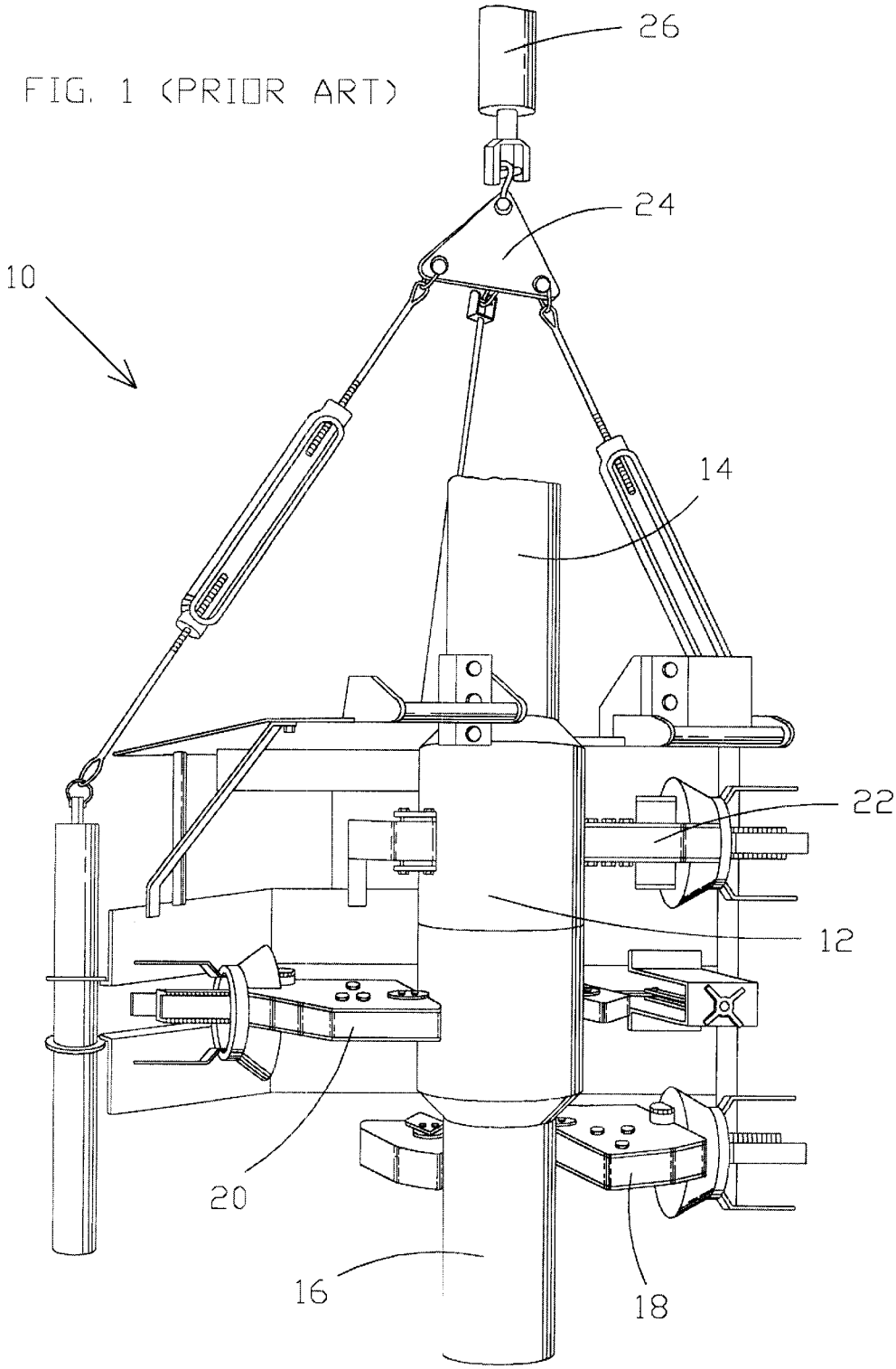
FIG. 1 (PRIOR ART)
FIG. 1 is a perspective view of a self-contained makeup and break out unit suspended on a support cable as used in the prior art.

Referring now to the drawings, and more particularly to FIG. 1, which shows components 18, 20, and 22, which may be referred to generally as tongs, wrenches, torque arms, jaws, or the like. Torque arms 18, 20, and 22 are secured together in a vertical orientation within self-contained unit 10 for making and breaking joints 12 of tubular 14 and 16. While tubular 14 and 16 are normally substantially vertically oriented, unit 10 and/or other means discussed subsequently will preferably include a tilt mechanism whereby tubular, such as those offset somewhat from the vertical, may be engaged by torque arms 18, 20, and 22. For instance, tubular positioned in the mousehole may be offset from the vertical and unit 10 may still be used to make and break connections of such tubular. A prior art connection 24 to support line 26 is shown as has been used in the prior art. The present invention makes support line 26 optional.

Figure 2:
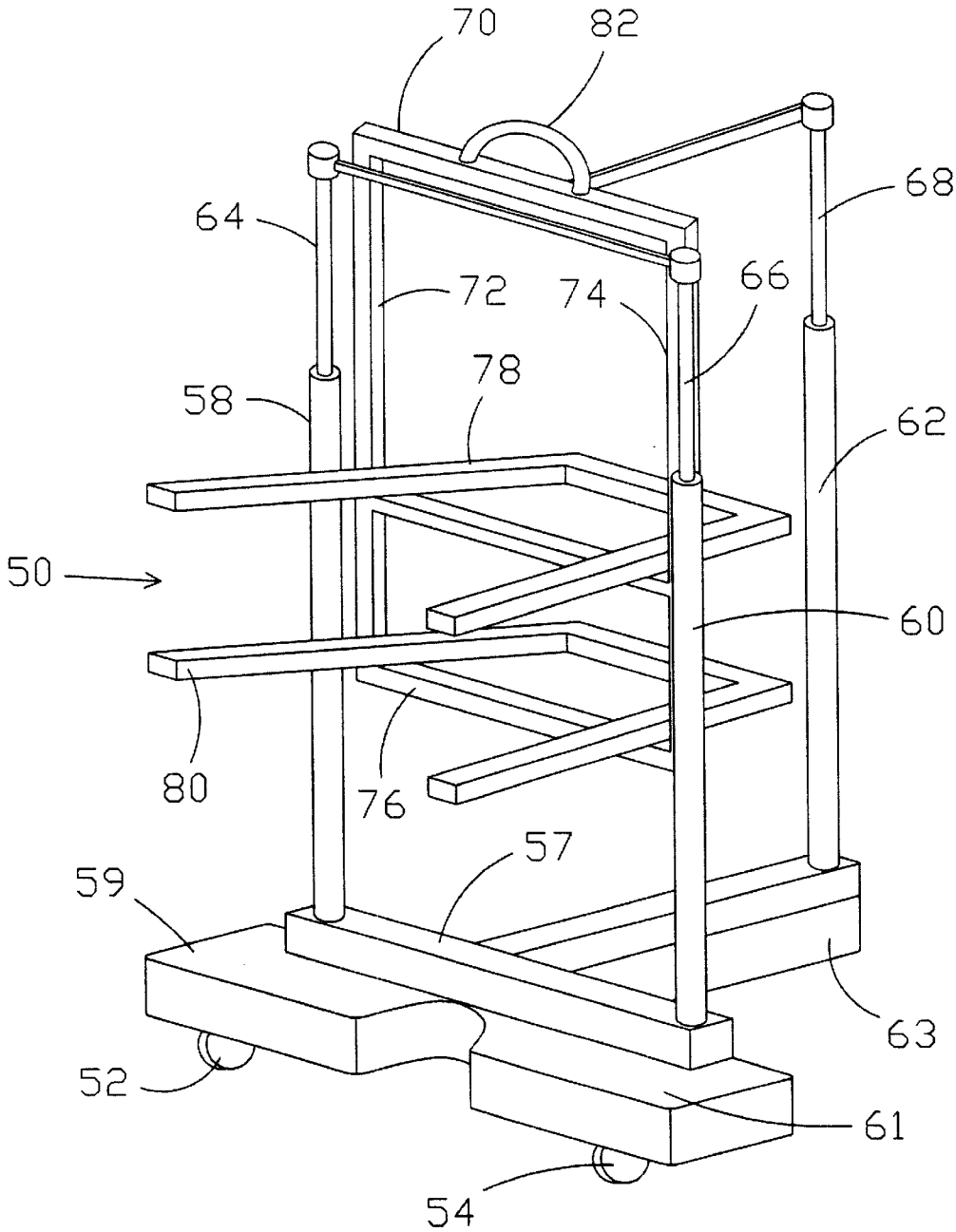
FIG. 2 is a perspective view of a mobility component for a self-contained makeup and break out unit in accord with the present invention.
Figure 3:
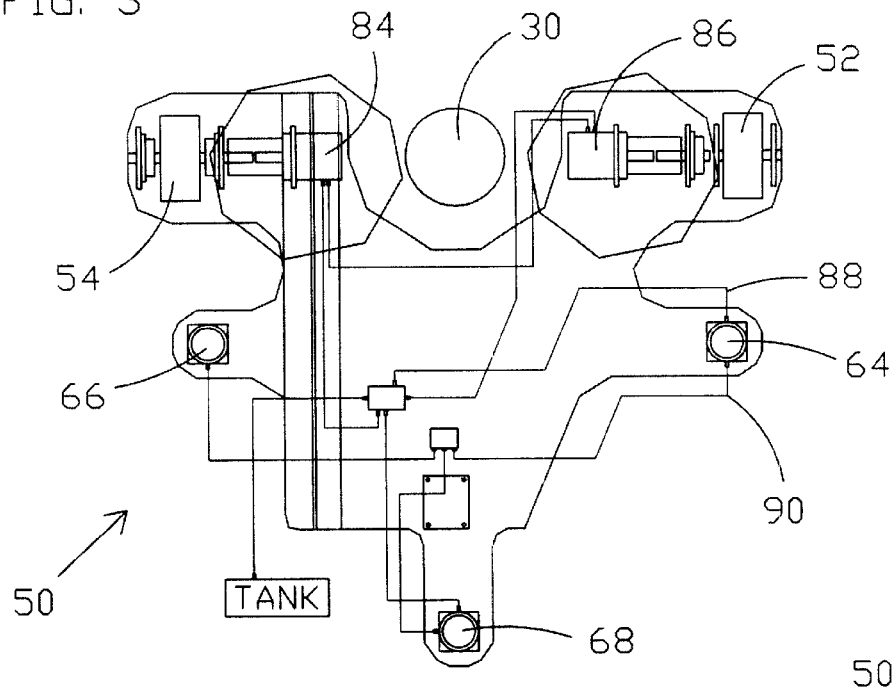
FIG. 3 is a lower plan view, partially in section, of the mobility component of FIG. 2.
Figure 4:
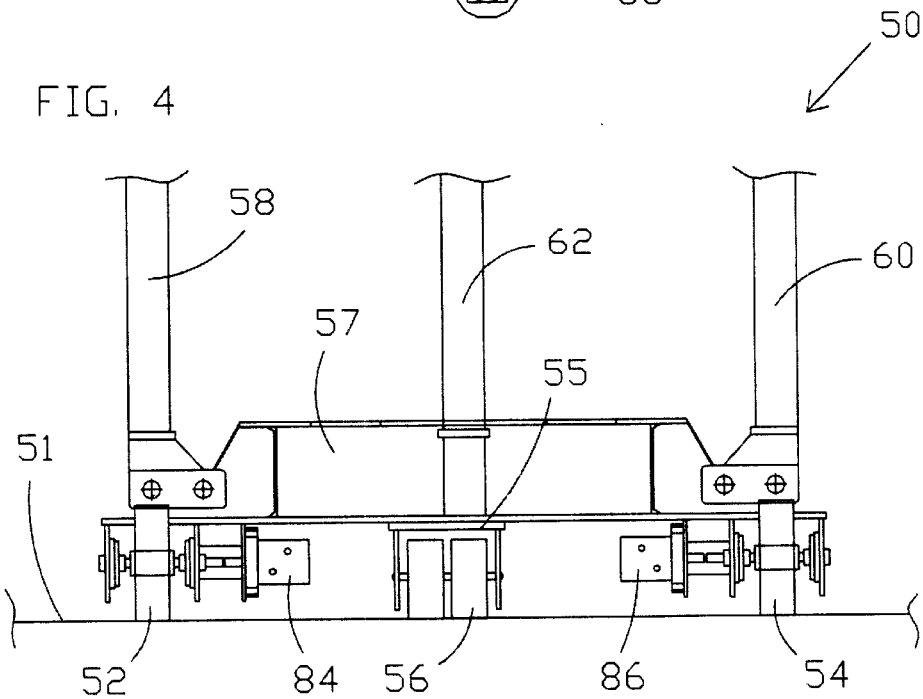
FIG. 4 is a partial elevational view, partially in section of the mobility component of FIG. 2.

FIG. 2 shows support elements of mobility unit 50 in accord with the present invention. Mobile unit 50, as shown in FIGS. 2–4, preferably provides for individually powered front wheels 52 and 54 to move mobile unit 50 on rig floor 51 (See FIG. 4). Rig floor 51 includes the operation floor of any type of rig such as drilling rigs and work over rigs, offshore rigs, drill ships, and any other type of well bore drilling or work over operation which has a suitable floor for movement by means of wheels such as wheels 52 and 54.

Wheels 52 and 54 are preferably mounted in a fixed orientation but are separately controllable by one or more hydraulic motors to make mobile unit 50 highly maneuverable on rig floor 51. The hydraulic controls are discussed briefly in connection with FIG. 3. Follower wheel(s) 56 provides support of the rear of mobile unit 50 on swivel mount 55. Front wheels 52 and 54 provide controllable movement of self-contained unit 10 for placing unit 10 in position for working with the pipe. During the making and breaking operation, unit 10 will typically move circularly typically less than one-quarter turn during final makeup or initial break out as relatively high torque is applied. The rotation is around the drill pipe because the drill pipe is fixed in position with respect to horizontal movement. Therefore front wheels 52 and 54 may be preferably positioned such that rotation is easily permitted. For instance, front wheels 52 and 54 may be positioned substantially in line with pipe 30 as shown in FIG. 3 such that a straight line can be drawn between front wheels 52 and 54 and pipe 30 when the torque arms are gripping the pipe. With this wheel positioning, rotational movement of unit 10 is easily followed by front wheels 52 and 54. Moreover, front wheels 52 and 54 may be in a neutral position such that they can roll easily or perhaps roll with damped movement during the makeup and break out rotation. A control may be provided such that wheels 52 and 54 are substantially in a neutral position when two torque wrenches are engaged. The preferred positioning of the wheels permits mobile unit 50 to be highly maneuverable and in fact mobile unit 50 can rotate in position when the wheels are positioned as shown although other wheel positions could be selected as desired.

Rear wheel 56 is preferably a follower wheel that is swivel mounted to follow movement of wheels 52 and 54. Rear wheel 56 preferably includes one swivel mounted wheel or two swivel mounted wheels 56 as shown to provide additional support. Base 57 is sized to provide an adequate footprint for wheels 52, 54, and 56 to sturdily support unit 10 while being small enough to be maneuverable on the rig floor. Preferably base 57 includes wheel guards 59, 61, and 63 to protect from feet inadvertently placed in the path of the wheels. The wheel guards 59, 61, and 63 may include relatively soft rubber bumper portions if desired. Because mobile unit 50 moves relatively slowly, should a person inadvertently position a foot in the wheels path, the wheel guards would not injure a person upon contact but would give ample notification to permit movement of the person's feet. The operator's position is selected to be away from moving components, preferably in the front of mobile unit 50. However, it would be possible to provide a control unit adjacent the driller's position whereby a single driller could perform most functions associated with making and breaking the pipes. While a reverse tricycle wheel orientation of the plurality is preferred, other wheel arrangements and numbers of wheels could be used. By reverse tricycle wheel orientation is meant two wheels or two groups of wheels in the front of mobile unit 50 (the side with power arms) and one wheel or group of wheels in the rear. The two front wheels are fixed in position but can be steered in a highly maneuverable manner by individual application of power. The rear wheel is preferably a follower wheel and preferably swivels to follow movement. However, the design could provide that the rear wheel is powered for movement and rotation while the two front wheels are followers. While the reverse tricycle wheel orientation is one wheel orientation that permits rotation in place as well as movement of mobile unit 50, other wheel orientations that provide the same or similar functions could be used.

Hydraulic supports 58, 60, and 62 provide hydraulic means for vertically positioning unit 10 with respect to joint 12. In this way, the particular tongs or wrenches 18, 20, and 22 can be positioned at the desired positions. Preferably vertically oriented hydraulic cylinders 58, 60, and 62 drive respective hydraulic rods 64, 66, and 68 that is mount lift frame or support member 70. Lift frame or support member 70 provides members such as side members 72 and 74 and bottom member 76 for connection to unit 10. Preferably unit 10 is vertically movable with respect to cylinders or supports 58, 60, and 62. Additional support elements 78 and 80 may also be used for connection to unit 10 as desired. It will be understood that lift frame 70 is shown in a conceptual form and that various modifications may be made for a secure connection with respect to unit 10 as desired. Lift frame 70 may be provided as a readily removeable add on component or may be built into the design of unit 10 as desired. Supports 58, 60, and 62 may be pivotally mounted, if desired, to permit tilting of unit 10. While vertically or substantially vertically oriented hydraulic supports are preferred, other mechanical arrangements could conceivably be used such as rotating screws for lifting, folding or expanding frames, and the like whereby either hydraulic forced is applied differently or other means of power such as air or explosion proof electric power devices are used.

Support line connector 82 is provided so that unit 10 may be lifted by support line either during transport or for operation within the rig. For instance, one use of a combined unit 10 allows the positioning at places in the rig which may be elevated with respect to the rig floor to break connections that are well off the rig floor as may occur due to stuck pipe and the like.

FIG. 3 and FIG. 4 show hydraulic motors 84 and 86 used to operate front wheels 52 and 54 as well as various hydraulic lines. Also shown are hydraulic lines such as hydraulic lines used to operate the hydraulic lift rods, such as hydraulic lift rods 64, 66, and 68. The hydraulic controls permit a single operator to move self-contained unit 10 to engage pipe 30, and perform the necessary functions. The hydraulic operation eliminates the need for support lines and the unit can be easily moved out of the way when desired. While a preferred embodiment of the invention utilizes hydraulic power, air motors and air lifts may also be used if desired. If desired, it may be possible to use electrical equipment for operation on the rig floor if explosion proof electrical construction is utilized.

In operation, hydraulically controlled wheels 52 and 54 can be used to move unit 10 to engage the pipe joint. Follower wheel(s) 56 follow guidance of controlled wheels 52 and 54. After unit 10 is positioned adjacently the pipe, hydraulic rods 64, 66, and 68 move lift frame 70 up and down as necessary to properly position torque arms 18,20, and 22 with respect to the pipe joint. If the pipe is to be broken, then two torque arms break the connection. During the breaking of the pipe, unit 10 will rotate a few degrees around the pipe. Wheels 52 and 54 are positioned to facilitate such movement and may be in neutral or a damped neutral position that allows such rotation. A spinner unit (not shown) then spins the pipe until the pipe is ready to be separated. As the removed pipe or group of pipes is being positioned, unit 10 may be moved out of the way so that the blocks can pull the next joint to be broken into position above the rig floor. Making up of the pipe proceeds substantially the same in the opposite order.

Figure 5:
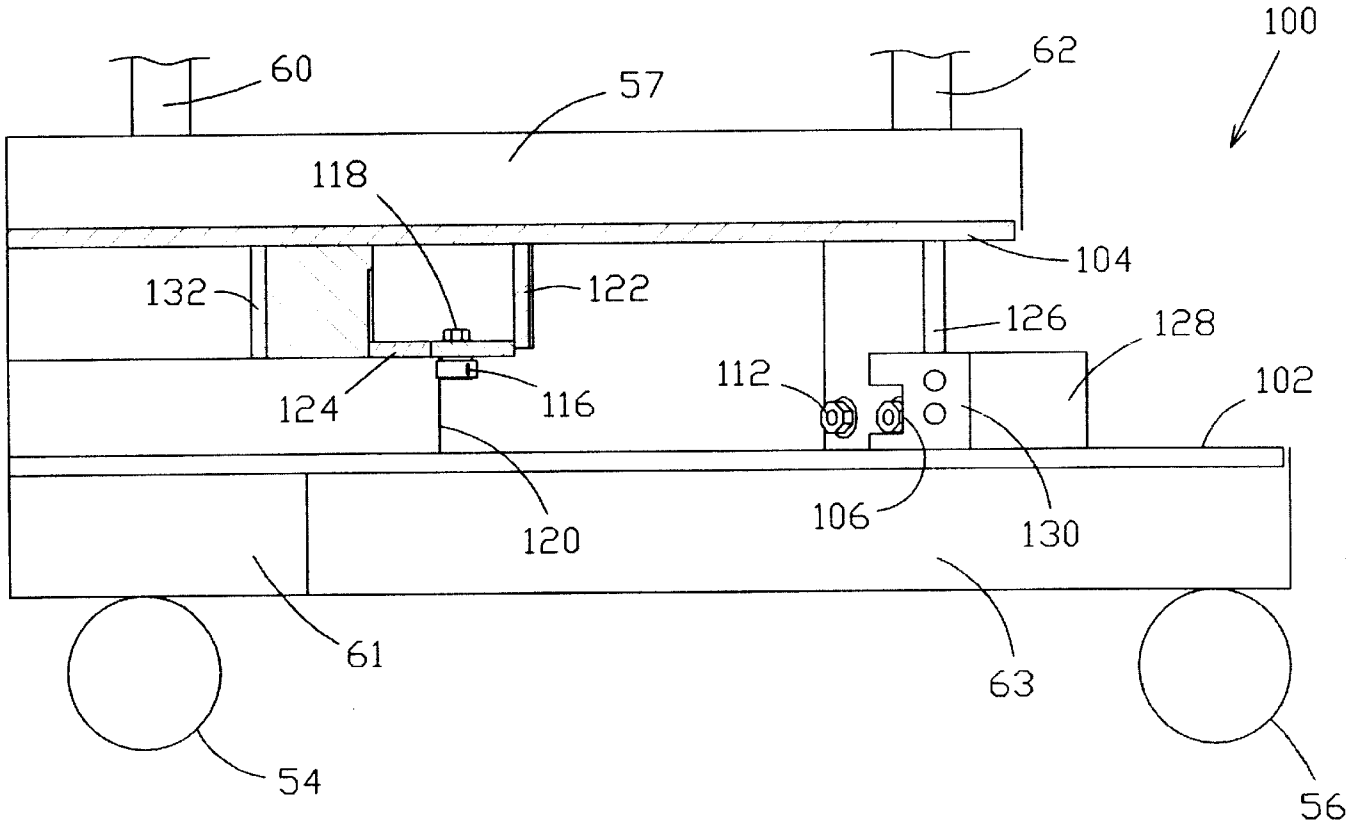
FIG. 5 is an elevational view, partially in section, of an embodiment of the present invention with a swivel section.
Figure 6:
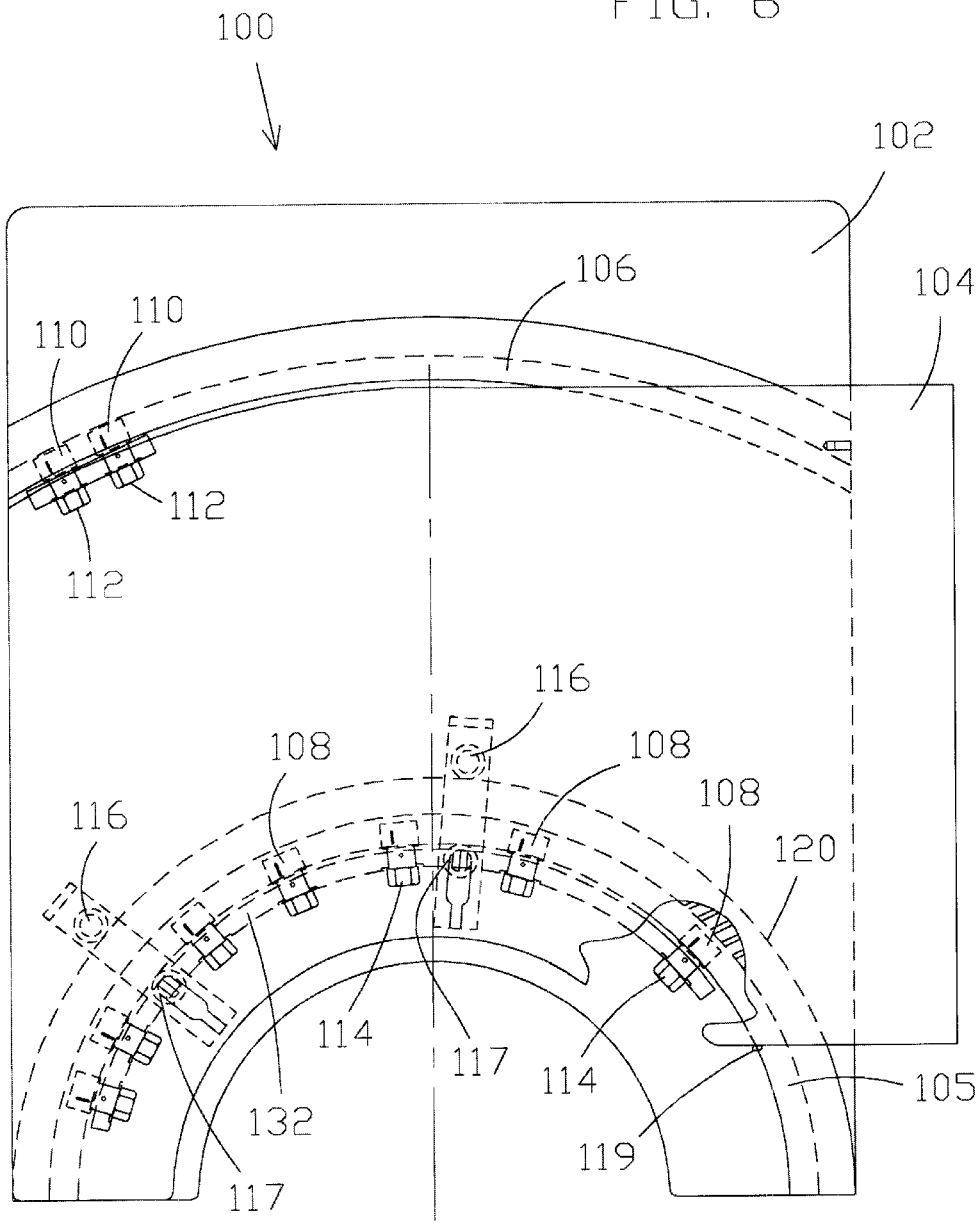
FIG. 6 is a top view, partially in section, of the swivel section of FIG. 5 in a first position.
Figure 7:
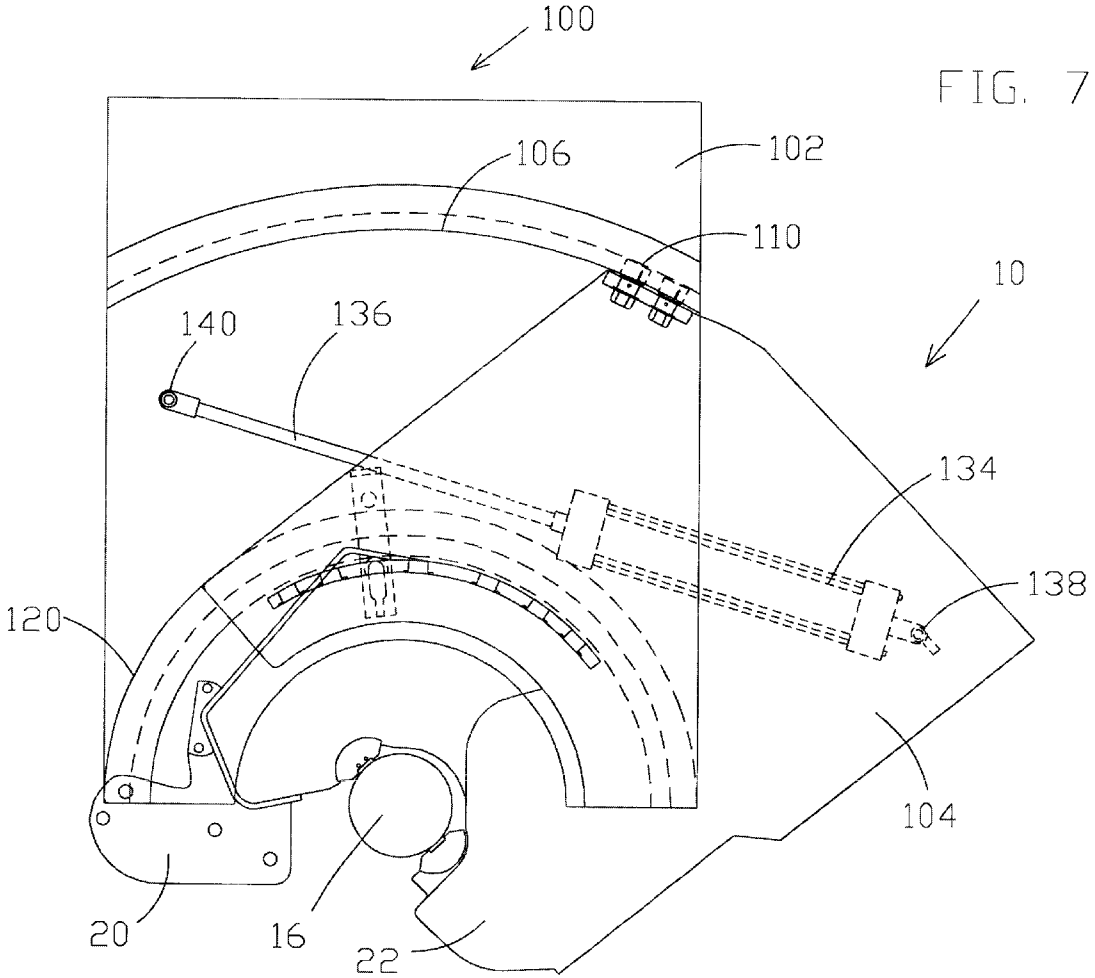
FIG. 7 is a top view, partially in section, of the swivel section of FIG. 5 in a second rotated position as compared to FIG. 7.

FIG. 5, FIG. 6, and FIG. 7 show another embodiment of the present invention which incorporates swivel stand 100 into mobility unit 50. Due to rotation that is induced by unit 10 as pipes 14 and 16 are broken or tightened, for some drilling rig floor arrangements it may be desirable that wheels 52, 54, and 56 do not rotate during tightening or loosening as discussed above. However, unit 10 must still rotate. Therefore swivel stand 100 is incorporated into mobility unit 50 to permit unit 10 to rotate while wheels 52, 54, and 56 as well as wheel guards 59, 61, and 63 remain stationary or substantially stationary. Swivel stand 100 may built into mobility unit 50 at a desired position therein. For instance, swivel stand 100 may, but not necessarily, can be positioned below supports 78 and 80 which support unit 10 and which may preferably rotate therewith. Swivel stand 100 will be positioned at some position above wheels 52, 54, and 56. Thus in one embodiment, lower swivel plate 102 may be positioned on mobility unit 50 above or adjacent wheel guards 59, 61, and 63 as indicated in FIG. 5. Upper swivel plate 104 will then support unit 10 and will swivel or rotate with respect to lower swivel plate 102. In this way, wheels 52, 54, and 56 may remain substantially stationary as unit 10 rotates as joints of pipe are connected or disconnected.

In one presently preferred embodiment, multiple swivel support wheels may be used between lower swivel plate 102 and upper swivel plate 104 to provide for relative rotation. For instance, a primary track 105 may be provided in which a plurality of primary wheels 108 are positioned. To maintain balance of the weight of unit 10 over primary wheels 108, a secondary track 106 may be provided with secondary wheels 110. In a present embodiment, the wheels are mounted by bolts and nuts such as bolt/nut arrangements 112 for secondary wheels 110 and bolt/nut arrangements 114 for primary wheels 108. To provide additional balance and support of the weight of unit 10 over primary wheels 108, outer lateral wheels 116 may be used that travel along surface or wall 120. Outer lateral wheels 116 and wall 120 may be oriented perpendicular or transversely with respect to primary wheels 108 and track 105. Bolt/nut arrangement 118 may be used to mount outer lateral wheels 116. Supports 122 and 124 may be used to support outer lateral wheels 116 and move with lateral wheels 116 during rotation. Inner lateral wheels 117 may also be used and travel along inner wall 119.

Secondary support or wall 126 moves with secondary wheels 110 as secondary wheels 110 are mounted onto support or secondary wall 126 by means of bolt/nut arrangements 112. Securing block 128 is mounted to lower swivel plate 102 and secures track support 130 which contains track 106 to lower swivel plate 102. Support or wall 132 provides mounting for primary wheels 108 and moves with primary wheels 108. Other wheel arrangements and means could be provided to permit relative rotation between lower swivel plate 102 and upper swivel plate 104.

FIG. 7 shows swivel stand 100 in a rotated position. Thus, secondary wheels 110, as well as the primary wheels and other wheels discussed herein before have been rotated along their respective tracks, such as track 106, track 105, surface 120, and the like. FIG. 7 also shows various components of unit 10 to indicate how the various components relate together. Cylinder 134 and cylinder push rod 136 or other means may preferably be used to return unit 10 to the first position shown in FIG. 5 and FIG. 6 from the second or rotated position as indicated in FIG. 7. For this purpose, cylinder push rod 136 may be secured through various frame interconnections so as to be affixed with respect to lower swivel plate 102. On the other hand, cylinder 134 is secured to upper swivel plate 104. Thus, cylinder 134 and cylinder push rod 136 may be used to control rotation between lower swivel plate 102 and upper swivel plate 104 such as by returning the relative position from the second or rotated position of FIG. 7 to the first or unrotated position shown by FIG. 5 and FIG. 6. Cylinder 134 may be hydraulically or pneumatically operated.

The present invention is adaptable to other type of movement control. For instance, instead of hydraulically operated wheels, a telescoping boom could be used to move mobility unit 50 wherein wheels may or may not be hydraulically operated, as desired.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various coring elements may be made without departing from the spirit of the invention.

What is claimed is:

1. A maneuverable power jaw apparatus for making and breaking joints of well bore tubular, comprising:

at least two powered torque arms for applying torque to said joints of said well bore tubulars;

a support frame for supporting said at least two powered torque arms; a mobile frame for supporting said support frame and said at least two powered torque arms, said support frame being movable with respect to said mobile frame;

one or more hydraulically movable members mounted between said support frame and said mobile frame;

a swivel stand for supporting the mobile frame and to permit rotational movement of the mobile frame with respect to the rig floor; and at least three wheels mounted to the swivel stand to permit movement of the apparatus on a rig floor.

2. The maneuverable power jaw apparatus of claim 1, wherein said wheels comprise:

a first wheel mounted to said mobile frame with a fixed orientation, and a second wheel mounted to said mobile frame with a fixed orientation.

3. The maneuverable power jaw apparatus of claim 2, further comprising:

a first hydraulic control for said first wheel, and a second hydraulic control for said second wheel.

4. The maneuverable power jaw apparatus of claim 2, further comprising:

a third wheel mounted to said mobile frame.

5. The maneuverable power jaw apparatus of claim 4, wherein said third wheel is swivel mounted with respect to said mobile frame.

6. The maneuverable power jaw apparatus of claim 1, wherein said wheels comprise at least one swivel mounted wheel.

7. The maneuverable power jaw apparatus of claim 1, wherein said wheels comprises at least two swivel mounted wheels.

8. The maneuverable power jaw apparatus of claim 1, wherein said wheels comprise at least two wheels, said two wheels being mounted to said mobile frame such that a straight line passes through each of said two wheels and a respective of said well bore tubular when said at least two power torque arms apply said torque.

9. The maneuverable power jaw apparatus of claim 1, wherein said wheels comprises at least three swivel mounted wheels.

10. A maneuverable power jaw apparatus for making and breaking joints of well bore tubular, said maneuverable power jaw apparatus being operable on a rig floor, comprising:

at least two powered torque arms for applying torque to said joints of said well bore tubulars;

a mobile frame for supporting said at least two powered torque arms;

a swivel stand for supporting the mobile frame and to permit rotational movement of the mobile frame with respect to the rig floor; and at least three wheels mounted to said swivel stand to permit movement of said apparatus on said rig floor.

11. The maneuverable powerjaw apparatus of claim 10, wherein at least one of said at least three wheels is swivel mounted to said mobile frame.

12. The maneuverable power jaw apparatus of claim 10, further comprising:

a first hydraulic motor for a first of said at least three wheels.

13. The maneuverable power jaw apparatus of claim 12, further comprising:

a second hydraulic motor for a second of said at least three wheels.

14. The maneuverable power jaw apparatus of claim 10, further comprising:

a support member for supporting said at least two powered torque arms, said mobile frame supporting said support member such that said support member and said at least two powered torque arms are movable with respect to said mobile frame, and at least one movable member mounted to said mobile frame and said support member for affecting movement between said mobile frame and said support member.

15. The maneuverable powerjaw apparatus of claim 14, wherein said at least one movable member comprises a hydraulic rod.

16. The maneuverable power jaw apparatus of claim 14, wherein said support member is vertically movable with respect to said mobile frame.

17. A maneuverable power jaw apparatus for making and breaking joints of well bore tubular, comprising:

at least two powered torque arms for applying torque to said joints of said well bore tubulars;

a support frame for supporting said at least two powered torque arms;

a mobile frame for supporting said support frame and said at least two powered torque arms;

a pivotal connection between said support frame and said mobile frame such that said support frame is pivotal with respect to said mobile frame;

a swivel stand for supporting the mobile frame and to permit rotational movement of the mobile frame with respect to the rig floor; and at least three wheels mounted to said swivel stand to permit movement of the mobile frame on a rig floor.

18. The maneuverable power jaw of claim 17, wherein said one or more wheels comprise:

a first wheel mounted to said mobile frame with a fixed orientation, and a second wheel mounted to said mobile frame with a fixed orientation.

19. The maneuverable power jaw apparatus of claim 17, wherein said pivot connection further comprises:

one or more tracks affixed to said mobile frame, and a plurality of wheels moveably in said one or more tracks.

20. The maneuverable power jaw apparatus of claim 17, further comprising:

a cylinder connected between said mobile frame and said support frame, said cylinder being activated for pivoting said support frame with respect to said mobile frame.

21. The maneuverable power jaw apparatus of claim 17, wherein said wheels comprises at least three swivel mounted wheels.

* * * * *